US008020713B2

(12) United States Patent
Crincoli et al.

(10) Patent No.: US 8,020,713 B2
(45) Date of Patent: Sep. 20, 2011

(54) STORAGE RACK FOR PILATES EXERCISE EQUIPMENT

(76) Inventors: Carol Crincoli, New Providence, NJ (US); John Pabst, Jr., Roselle, NJ (US); Americo Giovanni Crincoli, Linden, NJ (US)

( * ) Notice: Subject to any disclaimer, the term of this patent is extended or adjusted under 35 U.S.C. 154(b) by 0 days.

(21) Appl. No.: 12/583,730

(22) Filed: Aug. 25, 2009

(65) Prior Publication Data

US 2010/0051566 A1 Mar. 4, 2010

Related U.S. Application Data

(60) Provisional application No. 61/092,812, filed on Aug. 29, 2008.

(51) Int. Cl.
*A47F 7/00* (2006.01)

(52) U.S. Cl. ..... 211/85.7; 211/60.1; 211/106.01; 482/129

(58) Field of Classification Search ..... 211/85.7, 211/113, 106.01, 60.1, 65, 66; 482/129, 482/130; 248/304
See application file for complete search history.

(56) References Cited

U.S. PATENT DOCUMENTS 798,114 A * 8/1905 Rosenthal ..... 482/130
850,576 A * 4/1907 Hess et al. ..... 211/65
1,613,447 A * 1/1927 Ellberg ..... 211/123
2,584,644 A * 2/1952 Carlo ..... 211/65
2,715,966 A * 8/1955 Tieck ..... 211/94.01
2,919,134 A * 12/1959 Zuro ..... 482/129
3,524,644 A * 8/1970 Kane ..... 482/129
3,825,252 A * 7/1974 Geiger ..... 482/129
4,129,217 A * 12/1978 Campbell ..... 211/95
4,633,918 A * 1/1987 Lachman et al. ..... 140/71 R
D344,673 S * 3/1994 Effron ..... D8/373
5,399,139 A * 3/1995 Malynowsky ..... 482/129
5,706,737 A 1/1998 Whitehead
6,161,703 A * 12/2000 Mihok ..... 211/31
6,330,949 B1 12/2001 DeRisio
6,390,309 B1 5/2002 Tucker
6,695,154 B2 2/2004 Jacobs
6,767,234 B1 7/2004 Rosa
7,213,713 B2 5/2007 Matsui
7,318,530 B2 1/2008 Loch

* cited by examiner

*Primary Examiner* — Korie Chan

(74) *Attorney, Agent, or Firm* — Gearhart Law LLC

(57) ABSTRACT

The present invention discloses a storage rack suitable for holding exercise springs and related equipment, having a support element with at least one bracket disposed on the support, the bracket being suitable for horizontally affixing the support to a wall or ceiling. The support having a plurality of eye hooks disposed thereon. The eye hooks keep the exercise rings at a sufficient distance from each other to prevent entanglement with other springs. The distance between the support and the point of affixation can be used as a separate rack to store other exercise components.

15 Claims, 3 Drawing Sheets

STORAGE RACK FOR PILATES EXERCISE EQUIPMENT

CLAIM OF PRIORITY

This application claims the priority of U.S. Ser. No. 61/092,812 filed on Aug. 29, 2008, the contents of which are fully incorporated herein by reference.

FIELD OF THE INVENTION

The invention relates to a storage rack, in particular, a rack for storing components of the Pilates exercise equipment.

BACKGROUND OF THE INVENTION

The present invention relates to a storage device, in particular to a rack for storing Pilates exercise equipment. Pilates exercise equipment uses springs in combination with handlebars or stirrups, as tension elements. These tension elements need to be stored in a way that would permit a quick and orderly access while avoiding entanglement among the various springs. Although an idea of a rack for hanging objects is not new, the need to store the Pilates equipment has never been adequately addressed with a proper rack.

Known prior art wall mounted racks include U.S. Pat. No. 5,706,737; U.S. Pat. No. 6,330,949; U.S. Pat. No. 6,390,309; U.S. Pat. No. 6,695,154; U.S. Pat. No. 6,767,234; U.S. Pat. No. 7,213,713; and U.S. Pat. No. 7,318,530.

The U.S. Pat. No. 5,706,737 discloses a wall mounted, multi-purpose storage apparatus having interchangeable shelving for use in storage of sporting goods. Shelf construction consists of rod members or alternatively, shelf construction may consist of a single plastic piece having steel tubes integrated into the shelf. Structural rigidity is provided through the rod members having steel tubing that is encapsulated in a plastic sleeve through a manufacturing process while the plastic shelf has the steel tube directly integrated.

The U.S. Pat. No. 6,330,949 discloses a hanger system including a support member and at least one looped cord hanging from the support member. The looped cord includes a cleat or other adjustable fastener for adjusting the diameter of the loop, so that it fits around and securely holds differing sizes of items in the loop, preferably, up off the ground or floor.

The U.S. Pat. No. 6,390,309 describes an apparatus for holding sporting equipment. The rack includes a pair of U-shaped arms spaced apart from one another and in a generally equivalent horizontal position. At least one flexible longitudinal support is suspended between the arms and at least one flexible lateral support is suspended between opposing ends of each arm.

The U.S. Pat. No. 6,695,154 describes a rack for supporting and displaying recreational boards wherein at least a potion of design features of each of the recreational boards is simultaneously available for visual inspection. The rack includes mounting members, an elongated support member, and securing members.

The U.S. Pat. No. 6,767,234 discloses a display system of having plug in extended display hooks for hanging products of various widths. A plug-in header module has a bull nose shaped display window for product descriptions and pricing, and extends frontwards to the end of the hooks.

The U.S. Pat. No. 7,213,713 discloses a storage system for securing a first piece of sports equipment and a second piece of sports equipment to a rigid structure that includes a first storage subassembly and a second storage subassembly. The first storage subassembly includes a left first frame and a spaced apart right first frame that are coupled to the rigid structure. The first frames cooperate to support the first piece of sports equipment. The second storage subassembly includes a left second frame and a spaced apart right second frame. The second frames are selectively coupled to the first storage subassembly. The second frames cooperate to support the second piece of sports equipment.

The U.S. Pat. No. 7,318,530 describes a skateboard security rack having a pair of support members defining a slot therebetween for receiving the deck of a skateboard. At least one of the support members has a width smaller than the wheelbase of the skateboard received in the slot. Locking structure between the support members and across the top of the slot retains the skateboard within the slot. The locking structure may be separate elements coupled to each of the support members and a lock therebetween.

Although all of the above patents disclose racks for holding various kinds of sports equipment, none can be easily adapted for storing Pilates equipment. In addition, most of the racks disclosed above intrude far into the open area, directly in front of the rack. Such setup creates an undesirable safety hazard and obstruction in high traffic areas, such as an exercise room or a gym. In contrast, the present invention is highly compact and does not require a wide clear area for deployment. In addition there are no sharp protruding components as in prior art, making this rack much more gym-friendly. However, the most desirable and novel feature of the present invention is the ability to store Pilates tension equipment in a manner that prevents entanglement and provides clear and easy access to the individual exercise components. Without the present invention, the springs would have to be left attached on a machine, where they would cause an obstruction and clutter, or be placed into a container or on an unsuitable rack, risking that the springs or other components may get entangled with each other, get deformed or become otherwise compromised.

One embodiment of this invention is illustrated in the accompanying drawings and will be described in more detail herein below.

SUMMARY OF THE INVENTION

The present invention discloses a storage rack suitable for holding exercise springs and related equipment, having a support element which has at least one bracket disposed on the support, the bracket being suitable for horizontally affixing the support to a wall or ceiling. The support having a plurality of eye hooks disposed thereon.

It is the object of the present invention to provide a rack to store long springs, in particular, to store Pilates equipment in an entanglement free manner.

Another object of the present invention is to provide for a compact way of storing Pilates exercise equipment.

Yet another object of the present invention is to provide a location to store handlebars and stirrups that are used by Pilates training equipment in combination with the springs.

Yet another object of the present invention is to provide storage a space for more than one Pilates exercise machine.

Yet another object of the present invention is to provide hooks on the support that are used to provide a mounting point for the bolt snap hooks disposed on one end of a Pilates spring.

Yet another object of the present invention is to provide a wall protector which would prevent a wall from being damaged by the springs.

Yet another object of the present invention is to adopt color coded Pilates tension sorting system in organizing the rack mounted springs.

DESCRIPTION OF THE PREFERRED EMBODIMENTS

Figure 1:
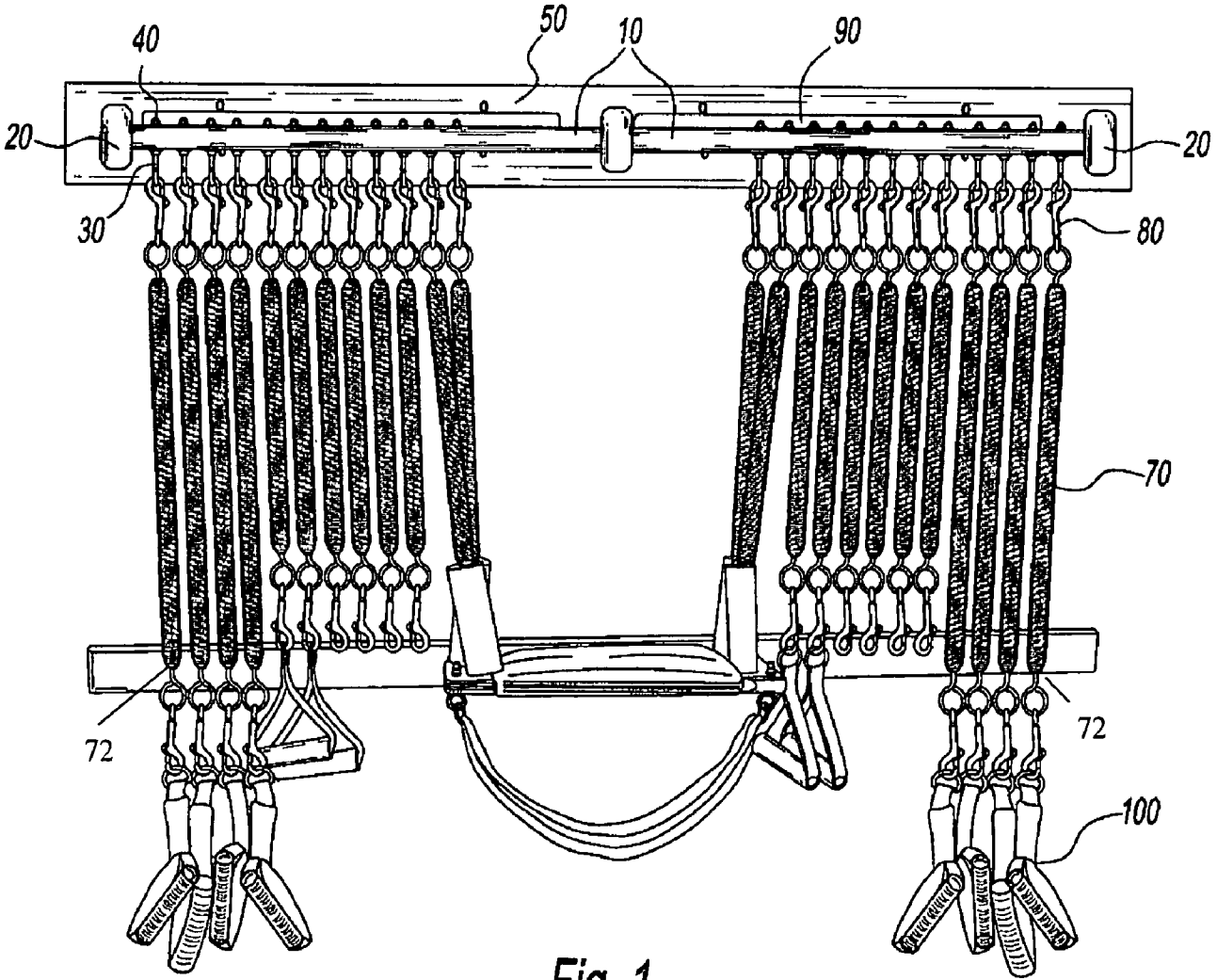
FIG. 1 is a front view of a preferred embodiment of the invention, showing a double rack, a support with eye hooks, several brackets, a wall plate and a wall protector plate, with plurality of Pilates exercise springs disposed on the eye hooks.

The preferred embodiments of the present invention will now be described with reference to FIG. 1-5 of the drawings. Identical elements in the various figures are identified with the same reference numerals.

FIG. 1 is a front view of the present invention showing a double rack with all hooks engaged by the Pilates tension elements. Shown are a support 10, a bracket 20, eye hooks 30, nuts for the eye hooks 40, a wall plate 50, a wall protector 60, a plurality of Pilates springs 70, bolt snap hooks 80, a Pilates handlebar 90, and stirrups 100. One or both ends of the Pilates tension element, the spring 70, contains a bolt snap hook 80. The bolt snap hook 80 is integral with the spring 70 of a Pilates exercise machine or to a stirrup 100. In the case of the present invention, a bolt snap hook 80 would also be used to removably attach a spring 70 onto the support 10, for storage. The bolt snap hook 80 is integral to the Pilates spring 70.

Figure 5:
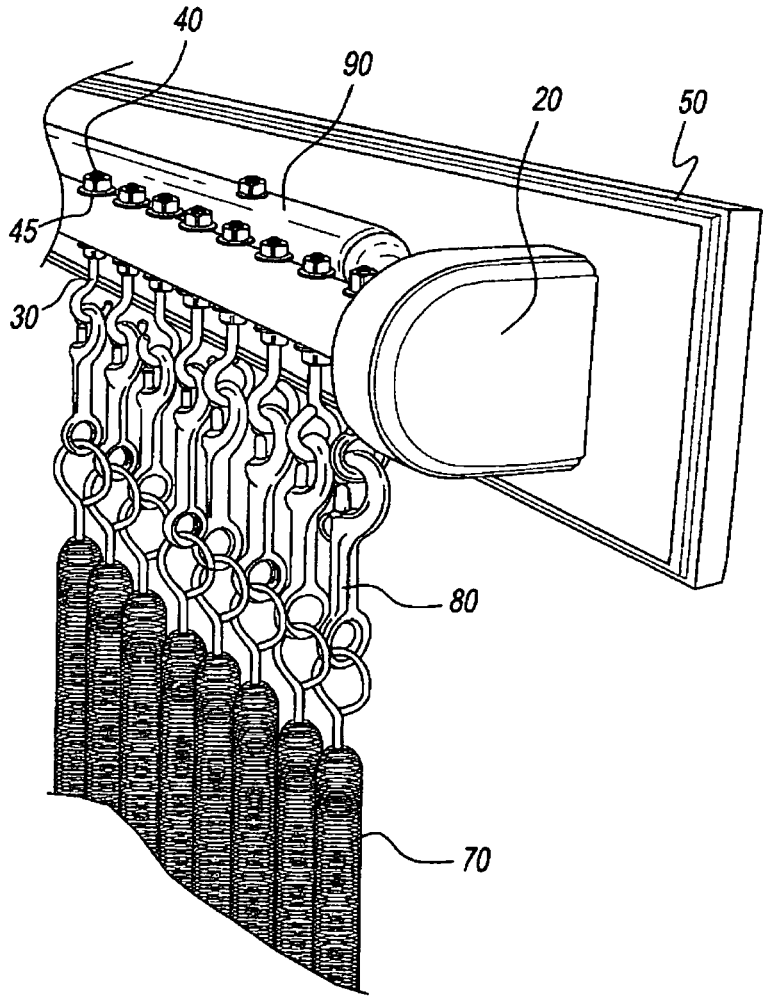
FIG. 5 is a perspective cutaway view of a support, a bracket and a wall plate assembly.

Still referring to FIG. 1, the support 10 is preferably from about 60 to 70 inches long and is from ½ inch to 4 inches in diameter, although the support can be of any length suitable to hold Pilates equipment for a single machine up to any number of machines. A single Pilates machine will typically need spots for 12 pieces of equipment. As seen in FIG. 5 below, the length of the support 10 for a rack housing a single Pilates machine would be about 24 inches. The rack can made longer to hold equipment for multiple machines. The support 10 should have at least four eye hooks 30, but may have as many as sixteen or more, depending on the length of the support 10 and on the spacing of the openings thereon.

The preferred embodiment displays the support 10 as being a metal tube. It can also be a three sided channel or a solid bar, and be manufactured out of any stiff material, such as a metal alloy, wood, plastic, or any composite of these materials. There are openings in the support 10 for inserting eye hooks 30. These openings may be evenly spaced, but can be randomly spaced as well. Ideally, the eye hooks 30 will be from 1½ inches to 2 inches apart, although other distances may be suitable depending on the overall width of the equipment being supported.

Still referring to FIG. 1, pictured are three support brackets 20 mounted at the terminus of the support 10. For the present invention to function as intended there needs to be at least one bracket 20 present that would attach the support 10 to a wall, stand, ceiling, or to a wall plate 50. In FIG. 1, the bracket is shown as being mounted onto a wall plate 50. The bracket 20 should preferably be made of wood, but can also be made of plastic, metal or any other hard and durable material. It is noted that other types of hooks or supports could be disposed on the outside of the supports or bracket, to hold other objects or equipment, such as towels, water bottles, other Pilates equipment, etc. The bracket 20 may contain several hooks disposed on any of the sides that are not used for attachment to a wall or ceiling or to accommodate the support 10. The support could also be attached to a freestanding rack or stand. Additional hooks on the bracket 20 would be one way of maximizing the storage capability of the present invention.

Still referring to FIG. 1, the wall plate 50 is pictured housing the brackets 20 of the present invention. Its main function is to protect the wall or ceiling from being damaged when the springs 70 are either added or removed from the support 10. The wall plate 50 would also be used to ease the installation process by requiring the installer to deal with one solid part rather then several individual brackets 20. The support 10 or wall plate 50 can be affixed to the wall or ceiling with standard fasteners. The wall plate 50 can be made of wood, plastic, rubber, metal, a metal alloy or a composite of these materials. For ascetic reasons and to provide better protection, the wall plate 50 should be slightly wider and longer than the support 10 and brackets 20. Also pictured in FIG. 1 are handlebars 90 for a Pilates exercise machine. The space between the wall plate 50 and the support 10, or a wall and a support 10, should preferably be made wide enough to insert and removably support the handlebars 90 in a horizontal position above the support 10. This may be one of a few ways to store the handlebars 90 without adding any extra hooks or shelves. The stirrups 100 can be stored separately or together with the springs 70, as shown in the FIG. 1.

Still referring to FIG. 1, the protector plate 60 is used to protect a wall from damage, which may occur during ordinary use of the present invention. A wall may become damaged, as the springs 70 are added or removed from the rack, if any of the stored components inadvertently swing toward the wall in a pendulum like motion, opposite the direction from the force being applied. Therefore a protector plate 60 may be used to minimize the likelihood of damage to the wall. To maximize the effectiveness of the protector plate 60, it should preferably be mounted opposite the distal ends 72 of the springs 70. The protector plate 60 should preferably be at least 2" and preferably 4 to 6 inches wide and as long as the wall plate 50. The protector plate 60 can be made of wood, plastic, metal or rubber, or any other durable, shock absorbing material.

Alternatively, the present invention need not contain the wall plate 50 or the protector plate 60. Only a bracket 20 and a support 10, along with eye hooks 30 need to be present to fulfill the main purpose of the present invention, which is to store the components of a Pilates exercise machine. The protector plate 60 would likely not be needed at all if the present invention is mounted on a ceiling, or away from any walls, or concrete walls, in an environment where damage would be unimportant.

Figure 2:
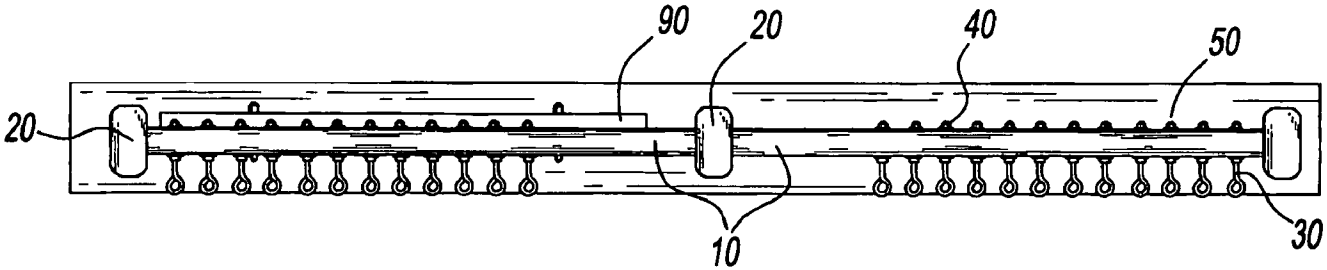
FIG. 2 is a front view of a preferred embodiment of the invention, showing a double rack with a wall plate, support, hooks and brackets.
Figure 3:
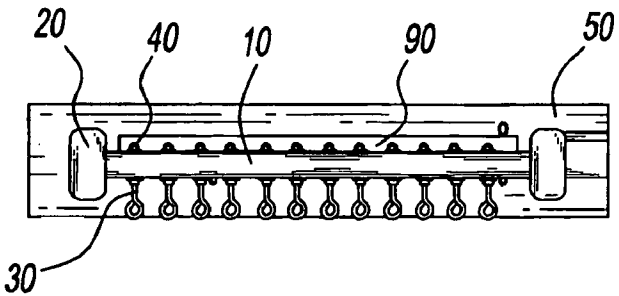
FIG. 3 is a front view of a preferred embodiment of the invention, showing a single rack with a wall plate, support, eye hooks and brackets.

FIGS. 2 and 3 both illustrate the front view of the top portion of the preferred embodiment of the present invention. Shown is a support 10, a bracket 20, eye hooks 30 and nuts for the eyehooks 40, and wall plate 50. FIG. 2 is a double rack while FIG. 3 is a single rack embodiment of the present invention. It is preferable that the bracket 20 be at the terminus of both ends of the support 10, to provide the strongest possible attachment to the wall or ceiling. As the support 10 gets longer, it may become desirable to place additional brackets 20 along the support 10 between the brackets 20 that are placed on the terminal ends of the support 10. The presence of the middle brackets 20 would depend on the length of the support 10 and on the weight of the exercise equipment that support 10 would be required to hold. Alternatively, for aesthetic reasons or if the mount space is limited, brackets 20 can be placed toward the middle of the support 10, without placing any brackets 20 on the terminal ends of the support 10.

Figure 4:
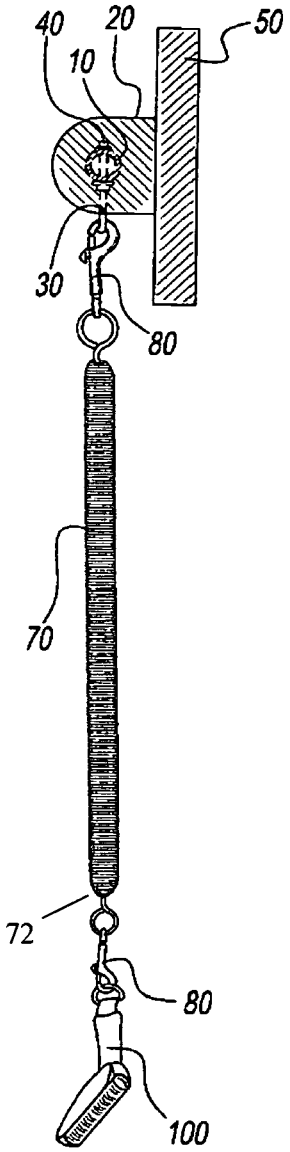
FIG. 4 is a side view of the present invention showing a wall plate, a bracket, a support with an eye hook running through it, and a spring, which is attached to a bolt snap hook that is attached to the hook.

FIG. 4 is a side view of the present invention. Shown is a support 10, a bracket 20, an eye hook 30, a nut for the eye hook 40, a wall plate 50, a Pilates spring 70, a distal end 72, having a bolt snap hook 80, and a stirrup 100. The wall plate 50 is shown to be substantially wider then the bracket 20. This is done to increase the aesthetic appeal of the present invention, and to maximize the wall protection offered by the wall plate 50. The bracket 20 is shown with the end opposite the attached end, as being rounded or substantially semicircular. This is preferable, since it contributes to a visually pleasing appearance of the present invention, while also eliminating any undesirable and unsafe edges. As pictured, the bracket 20 contains sufficient surface area to accommodate additional hooks disposed directly on it.

Still referring to FIG. 4, the eye hook 30 is inserted into, and all the way through the support 10. A nut 40 is mounted onto the distal end the eye hook 30 that is visible at the top of the support 10. The nut secures the eye hook 30 within the support 10. However, the opening may function in place of a nut 40 by having a threaded opening for the eye hook 30, thus eliminating the need for extra fastening hardware. This embodiment may be more suitable to a manufacturer wishing to minimize the complexity and the cost of producing the present invention.

FIG. 5 is a perspective view of the preferred embodiment of the present invention. Shown are a support 10, a bracket 20, eye hooks 30, nuts for the eye hooks 40, washers 45, a wall plate 50, Pilates springs 70, bolt snap hooks 80, and a Pilates handlebar 90. The eye hooks 30 are shown as having a completely closed eye or loop. Alternatively, the eye of the eye hook 30 may have an opening and be shaped more like a hook and less like a loop. See FIG. 5. This type of a hook will make hanging and removing the Pilates springs 70 a little easier since the bolt snap hooks 80 would no longer need to be opened before a spring 70 can be placed onto or removed from an eye hook 30. The washers 45 are used in conjunction with the nuts 40, to prevent the nuts 40 from coming loose and to lessen the wear on the support 10. While the present invention teaches eye hooks as the preferred medium for holding the Pilates springs, other types of holders may also be used. For example, a second wire bar, of about the same diameter as an eye hook, could be attached to the support along its length. Additionally, this bar could regularly spaced bends in it that would keep the snap hooks from sliding along it. The snap hooks could be attached along this bar.

The present invention is used as a rack for storing the Pilates springs 70 and other exercise equipment, such as handlebars 90 and stirrups 100. Pilates exercise machines use springs 70 as tension elements. The springs 70 typically contain bolt snap hooks 80 that are used to connect the springs 70 to the moving components of a Pilates machine, or to connect one end of a spring to a location on a Pilates machine, and the other to a stirrup or another device directly engaged by a person exercising on the machine. The springs or tension elements 70 are color coded to denote different levels of resistance. The eye hooks 30 of the present invention would use the bolt snap hooks 80, already present on the Pilates springs 70, to store the tension elements on a rack in a suspended position. This position prevents the springs 70 from coming into contact with each other, avoiding any undesirable entanglement between the springs. The rack can also be used to keep the springs 70 sorted in the order of greater or lesser resistance, by using a color code system in use by the Pilates machines. This is true because each spring would be clearly visible making the color ordering readily apparent to one wishing to select a spring 70 with desirable resistance.

Although this invention has been described with a certain degree of particularity, it is to be understood that the present disclosure has been made only by way of illustration and that numerous changes in the details of construction and arrangement of parts may be resorted to without departing from the spirit and the scope of the invention.

We claim:

1. A rack suitable for holding exercise springs and related equipment, comprising:

a cylindrical support;

a wall plate, fixably attached to a wall;

at least two brackets, configured to rigidly attach said cylindrical support to said wall plate such that said cylindrical support is located a fixed distance away from said wall plate, substantially parallel to, and at the same height as said wall plate;

six or more eye hooks, fixedly disposed on the underside of said cylindrical support, and a wall protector plate, having a substantially flat front surface, a thickness substantially equal to the thickness of said wall plate and a length substantially equal to the length of said wall plate, fixably attached to said wall, parallel and below said wall-plate, and separated from said wall plate by a predetermined, fixed distance substantially equal to a length of a relaxed Pilates spring and attached bolt snap hooks.

2. The rack of claim 1, wherein at least some eye hooks are closed.

3. The rack of claim 1, wherein comprising at least eight eye hooks.

4. The rack of claim 1, wherein the rack comprises at least three brackets.

5. The rack of claim 1, wherein the rack has sixteen hooks.

6. The rack of claim 1, wherein the support is a metal tube.

7. The rack of claim 1, wherein at least some of the eye hooks are equidistantly spaced.

8. The rack of claim 1, wherein the at least one bracket is made of wood.

9. The rack of claim 1 wherein said wall protector plate is made of wood, and wherein the wall protector is made of wood.

10. The rack of claim 1, wherein the rack has means for holding exercise fixtures.

11. The rack of claim 1, wherein the rack is suitable to hold exercise springs for at least two Pilates machines.

12. The rack of claim 1, wherein said wall protector plate is made of plastic.

13. The rack of claim 1, wherein said wall protector plate is made of metal.

14. The rack of claim 1, having at least eight Pilates springs disposed thereon.

15. A rack suitable for holding exercise springs and related equipment, comprising:

a cylindrical support;

a wall plate fixably attached to a wall;

at least two brackets, configured to rigidly attach said cylindrical support to said wall plate such that said cylindrical support is located a fixed distance away from said wall plate, substantially parallel to, and at the same height as said wall plate;

a wire bar rigidly attached beneath, and to, said cylindrical support and aligned substantially parallel to said cylindrical support, at a fixed, predetermined distance from said cylindrical support and wherein said wire bar has a plurality of regularly spaced bends; and a wall protector plate, having a substantially flat front surface, a thickness substantially equal to the thickness of said wall plate and a length substantially equal to the length of said wall plate, fixably attached to said wall, parallel and below said wall-plate, and separated from said wall plate by a predetermined, fixed distance substantially equal to a length of a relaxed Pilates spring and attached bolt snap hooks.

* * * * *